US008752637B1

(12) United States Patent
Childers

(10) Patent No.: US 8,752,637 B1
(45) **Date of Patent: *Jun. 17, 2014**

(54) EXTENDABLE CONDUCTOR STAND AND METHOD OF USE

(71) Applicant: Travis Childers, Central Valley, UT (US)

(72) Inventor: Travis Childers, Central Valley, UT (US)

(73) Assignee: Energy System Nevada, LLC, North Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/969,015

(22) Filed: Aug. 16, 2013

(51) Int. Cl.
*E21B 19/16* (2006.01)
*E21B 33/14* (2006.01)
*E21B 33/00* (2006.01)

(52) U.S. Cl.
CPC ..... *E21B 33/00* (2013.01)
USPC ..... 166/380; 166/379; 166/285

(58) Field of Classification Search
USPC ..... 166/378, 379, 380, 285, 85.1, 85.3, 166/85.4, 85.5, 90.1, 177.4, 243, 253.1, 166/250.14, 290
See application file for complete search history.

(56) References Cited

U.S. PATENT DOCUMENTS

| | | | | | |
|---|---|---|---|---|---|
| 3,347,567 | A * | 10/1967 | Watkins | 285/24 |
| 3,465,817 | A * | 9/1969 | Vincent | 166/355 |
| 3,721,292 | A * | 3/1973 | Ahlstone | 66/359 |
| 3,754,607 | A * | 8/1973 | Van Daalen | 175/7 |
| 4,135,841 | A * | 1/1979 | Watkins | 405/196 |
| 4,367,981 | A * | 1/1983 | Shapiro | 405/224.2 |
| 4,401,164 | A * | 8/1983 | Baugh | 166/379 |
| 4,434,853 | A * | 3/1984 | Bourgeois | 166/285 |
| 4,526,232 | A * | 7/1985 | Hughson et al. | 166/339 |
| 4,626,135 | A * | 12/1986 | Roche | 405/224.2 |
| 4,646,844 | A * | 3/1987 | Roche et al. | 166/379 |
| 5,069,488 | A * | 12/1991 | Freyer et al. | 285/302 |
| 5,211,228 | A * | 5/1993 | Watkins | 166/84.1 |
| 5,244,046 | A * | 9/1993 | Council et al. | 166/380 |
| 5,323,860 | A * | 6/1994 | Watkins | 166/341 |
| 6,173,781 | B1 * | 1/2001 | Milne et al. | 166/355 |
| 7,779,917 | B2 * | 8/2010 | Kotrla et al. | 166/345 |
| 8,033,335 | B2 * | 10/2011 | Orbell et al. | 166/367 |
| 8,459,361 | B2 * | 6/2013 | Leuchtenberg | 166/355 |
| 2006/0151176 | A1 * | 7/2006 | Moe | 166/355 |
| 2006/0157236 | A1 * | 7/2006 | Walker et al. | 166/85.4 |
| 2008/0251257 | A1 * | 10/2008 | Leuchtenberg | 166/355 |
| 2008/0264626 | A1 * | 10/2008 | Patton | 166/77.2 |
| 2012/0018171 | A1 * | 1/2012 | Robottom et al. | 166/379 |

* cited by examiner

*Primary Examiner* — Blake Michener
(74) *Attorney, Agent, or Firm* — J. Todd Rushton

(57) ABSTRACT

An extendable conductor stand allowing for rapid alignment and installation. The conductor stand having capacity to accept a BOP to protect against all blowouts, including behind the casing blowouts while drilling for "surface". The extendable conductor stand having a diverter spool configured to allow secondary cementing or performing a "top job" with BOP protection in place.

16 Claims, 6 Drawing Sheets

EXTENDABLE CONDUCTOR STAND AND METHOD OF USE

The patent of the present application is related to U.S. patent application Ser. No. 13/621,284, EXTENDABLE CONDUCTOR STAND HAVING MULTI-STAGE BLOW-OUT PROTECTION, filed Sep. 16, 2012, the disclosure therein incorporated by reference.

BACKGROUND

Drilling for oil or gas is a complicated and dangerous endeavor where drillers must blend both technology and experience to create a working well. The early stages of the well development are the most critical and due to the lack of blow-out protection, it is also the most hazardous period for the crew working the rig.

Setup for drilling an oil or gas well will vary depending upon location and ground conditions. However, a typical surface drilling operation would begin by preparing the site and grading the drill pad. Once the drill pad is leveled, the location for the conductor and cellar ring is determined. The cellar is typically a five foot to twelve foot diameter corrugated steel culvert pipe that is set into the ground. The cellar provides clearance for the diverter lines below the blow out protection, or BOP, and is available to control leakage and spills around the well bore. The cellar hole may be bored using a large diameter auger or simply dug out and refilled around the outside of the culvert pipe using an excavator. The next step is to set a relatively short string of large diameter conductor pipe. The conductor pipe will act as a drilling guide and prevents unconsolidated surface material from collapsing into the conductor hole. The conductor pipe averages 120 feet long for an on surface development, or a much longer string in an offshore drilling application. Where the surface material has allowable cohesive properties, the operator will first drill an oversized hole using an auger prior to inserting the conductor pipe into the hole. In other applications the conductor string may be driven to the desired depth. After being set to the desired depth, the space between the outside of the conductor pipe wall and original hole is cemented. Once the conductor pipe is in place and the cement has set, the operator will prepare and level the pipe end by cutting and/or grinding.

With the cellar and conductor string in place, the drill rig can now be moved onto location, centering the derrick over the cellar ring. The substructure, or subframe, typically elevates the subfloor, rotary beams, and table 25 to 50 feet above the ground. The derrick extends above the subframe.

The process of leveling and positioning the top of the conductor pipe with the subfloor is called "nippling up." Nippling up is time consuming, typically requiring 12 to 14 hours, and exposes the crew and equipment to hazardous working conditions. The first step is to determine the actual length of conductor pipe needed; this is accomplished typically by a welder extending a measuring tape from the subfloor to the top of the conductor pipe in the cellar. The measurement needs to be fairly accurate but will likely occur under adverse conditions such as the welder hanging over a 50 foot opening in the subfloor and the flexible tape being blown around by the wind. Once the length is determined, a suitable section of conductor pipe is selected from the parts tub; the pipe will likely have numerous welds and dents from previous installations. The conductor pipe may or may not have a flow nipple. If there is no flow nipple, the welder will cut a 10 or 12 inch hole in side of the conductor pipe near one end, grind and prepare the hole, shape a short section of reciprocal pipe that will be welded over the hole, perpendicular to the conductor pipe.

The flow nipple end of the conductor pipe is then attached to a winch or "air tugger" on the derrick and the base end is attached, using a sling or cable, to a piece of heavy equipment, such as a loader or excavator. In order to move the conductor pipe under the subframe, the operators must tension the slings using the air tugger to suspend the pipe horizontally and then slowly walk the equipment forward while maintaining tension with the air tugger and elevating the conductor pipe toward the rotary head. Once the conductor pipe is pulled under the subframe, the bottom sling is released and roughnecks on the ground will manually position the pipe over the conductor string in the ground and hold it in place. Additional manpower or rough necks are positioned in the cellar ring and will be responsible for aligning and holding the flow nipple position. Once alignment is achieved, a welder will tack the two sections of conductor pipe together before the roughnecks can release the pipe and the welder can complete the weld. The welder will then cut a hole near the base of the conductor and weld in a ¾ inch threaded collar or "threadolet", used to check for concrete returns when the drill casing is cemented in place.

If the conductor pipe is too long, the conductor stand will be removed from under the subframe, the welder will cut it down, and the fitting and welding process will start over. If the conductor pipe is too short, the conductor pipe is removed and an additional section of pipe is welded into place. With the conductor pipe completed, the rig can now start drilling. However, this drilling is without any blowout protection in place.

The next step is to "drill for surface" or drill a smaller hole through the conductor pipe, preparatory for setting the surface casing. The depth of the surface casing will vary depending on the depth of the ultimate target, ground conditions, surface anomalies and other factors. However, this step may be the most perilous; and the shallower the well bore, the greater the danger a surface anomaly will be to the men and equipment. During the drilling process it is common for the well bore to intercept pressurized water, as well as, gas pockets of methane or hydrogen sulfide in the rock or the coal formation being penetrated; the gases can be under extremely high pressure and are flammable. Drilling fluid or drilling "mud" is a mixture of water, clay and myriad other ingredients; the mud is injected under pressure down the center of the drill string, and as the mud recirculates back to the surface, on the outside of the drill string, the mud carries the rock cuttings out of the hole and serves to condition and seal the walls of the bore. Additionally, a driller may adjust the specific density of the drilling mud to increase hydrostatic pressure and help to control the flow of formation gas to the surface. However, if gas is encountered at shallow depth and the hydrostatic pressure of the drilling fluid in the vertical bore column is insufficient to overcome the pressure of the formation gas, the gas will blowout the top of the conductor pipe at high pressure and volume, potentially causing equipment damage and injury, and if the gas is flammable, the danger of an explosion and fire is also present.

Once "surface" has been set, a casing string will be inserted, through the conductor, into the surface hole and cemented into place. The cement is pumped down the inside of the casing under high pressure and will return to the surface outside of the casing; filling the voids between the casing string and the earth wall of the well bore, and the space between the casing and the conductor as the concrete reaches the surface. The casing is full when wet cement appears in the ¾ inch treaded collar at the base of the conductor. The operation must now wait until the cement has cured.

Once the casing cement has cured, the welder must now cut 3 to 4 inspection holes or working holes in the side of the conductor, and a rough cut to free the top portion of the casing. This operation is perilous. If the surface hole has intercepted even a low pressure gas pocket, sparks from cutting the casing may ignite the gases. It is typical for the welder to make the cuts while keeping his head and body below the inspection holes and limit exposure to the arm and hand.

The concrete between the conductor and the casing is visually inspected in order to see if the concrete has cured properly and is still adequately full around the casing. However, it is possible that during the curing time the concrete, that was once flowing out of the collar at the base of the conductor, has breached an anomaly in the formation which allowed the concrete to slump or "fall back" below the top of the casing. If there are indications of problems, the conductor pipe must completely cut and slung out from under the drilling subframe using the reverse procedure described above for bringing it in. The concrete level between the wall of the casing and conductor pipe is inspected visually and distance measurements may be taken by inserting a flexible tape down the conductor; if the concrete has fallen back, the resulting void must be refilled. However, since the concrete has now cured, you can no longer introduce concrete down the casing string and the concrete must be added from the surface in a procedure referred to as a "top job". When doing a top job, concrete must be ordered, brought to the drill site, and discharged directly down the space between the casing and the conductor. During this operation all personnel are exposed to the risks of what every type of anomaly the concrete fell back in to.

Once the casing is cemented in place, the casing can then be fitted with a BOP or blowout preventer. The BOP, as commonly known in the art, may be a ram or shear arrangement that blocks the well bore in the case of escaping gas or fluid. However, a BOP will not protect the drilling platform and crew until the surface casing is installed and a BOP installed on the surface casing string cannot protect the crew in the situation of a "behind casing blowout".

A behind casing blowout occurs when gas escapes towards the drill platform between the casing and conductor. This may occur because the pressure wave from the escaping gas shocks the casing wall, fracturing or separating the cement between the casing and the conductor. It is also postulated that the differential of thermal expansion between the steel and cement creates separations or channels where high pressure gas can pass through.

What is needed is a device that can be quickly installed during the conductor nipple up process; that will protect the drilling platform and crew during the surface drilling stage, and will protect the drilling platform and crew during a surface blow out or during a top job.

SUMMARY OF THE INVENTION

The present invention is an extendable conductor stand having blowout protection. The extendable conductor stand includes two sections of pipe, the bottom section most commonly will be the same diameter as the conductor string, and the top section is a larger diameter, which allows the bottom section to telescopically nest inside of the top section. For one embodiment, the top end of the top section and the bottom end of the bottom section will include a welded flange. In one embodiment, a seal arrangement is installed on the outside diameter of the bottom section and will engage the inside diameter of the top section, the seal preserves the pressure integrity of the structure. The seal arrangement may be constructed as stacked fiber seals, o-rings, neoprene, buna, viton, rubber bushing, or another known, or yet to be developed seal system. In yet another embodiment, a second seal arrangement is installed on the inside bottom diameter of the top section, providing a secondary seal for the assembly.

In one embodiment, the inside bottom edge of the top section includes a centering bushing to align the bottom section inside of the top section. The centering bushing may be configured as a bushing or spacer and constructed from a metallic material, such as aluminum, brass, or bronze or it may be constructed from a material such as nylon, high density polyethylene, or similar material.

In another embodiment, the top edge of the bottom section includes one or more centering guilds to align the top section with the bottom section. In yet another embodiment a centering ring or "chamfer ring" is fixed to the top end of the bottom section to allow for easy alignment of the drill bit, or drilling tools as they pass through the conductor stand.

In one embodiment, a spool section containing a flow nipple and the proper attachment for a rotary head can be attached to the top flange of the extendable conductor. The spool section can be fastened to the top section of the conductor in the same methods as described in the conductor section above.

The top section of the conductor stand can be extended from the bottom section or "telescoped" to the necessary length for proper position under the drilling rig platform and for installation of a rubber gasket fitted on the top of the rotating head. Once the proper length is achieved, set screws in a lock-collar can be tightened to fix the conductor stand length and hold the upper conductor stand assembly in position. In one embodiment the lock-collar can assist in maintaining alignment between the bottom conductor section and the top conductor section. In another embodiment, the lock collar includes wedges or dogs that are biased into a locked position by a set screw; the wedges or dogs create an interference lock against the outside surface of the bottom conductor section. It contemplated that the wedges or dogs may have an aggressively textured surface to engage the outside surface of the bottom conductor section. In yet another embodiment, the locking mechanism may be a manual, hydraulic or pneumatic, clamp or slip coupling that engages the outside diameter of the bottom conductor section. In one embodiment, safety rings may be attached or welded to the surface of the conductor sections; a cable or chain sling section may be attached to the safety rings and effectively link the two conductor sections together. This will protect the tool and personnel on the ground if the locking mechanism fails or a person forgets to tighten the locking collar prior to lifting the conductor stand into place.

In one embodiment, the top conductor section includes a junction where one or more spool pieces, or extension sections, of conductor pipe can be inserted. In situations where the drilling platform is elevated due to equipment arrangements, topography, or if the platform is in water, the operator can extend the conductor stand near the drilling platform prior to making final adjustments to the stand by telescoping the top conductor section from the bottom conductor section. In one embodiment, the junction will be a bolted flange fitting and in yet another embodiment, the conductor pipe junction may be threaded, having a thread end and a box end.

In one embodiment, the bottom section will include one or more gas choke lines or diverter lines. In yet another embodiment, the bottom section will have an additional flanged junction, above the diverter line or lines creating an independent diverter spool. One embodiment of the diverter spool including two or more diverter lines set at different heights on the diverter spool.

One or more BOP assemblies, such as a variable ram, may be installed in the junction between the diverter spool and the bottom section of the conductor. This arrangement allows the users to control any blowout situation whether the gas propagates up the borehole, through the casing, or is a behind the casing event. In the event the BOP is closed due to gas discharge, the diverter choke valve can be used to control the gas flow out of the well and to a flare stack where it can be safety burned off.

In yet another embodiment, one or more BOP assemblies may be installed in the junction of the top conductor pipe. The BOP assemblies may be installed with or without using an additional spool piece depending on the drilling platform height and application. It is contemplated to use a variable ram BOP assembly in the upper BOP stack section and the bottom BOP will have a shear ram to shear the drill string if necessary, in order to prevent any hydrocarbons from escaping. In a situation where there is a total blow out and integrity failure, the well can be shut down, or killed, by first closing the upper BOP or variable ram, followed by the lower BOP or shear ram in that order.

In another embodiment, the top conductor section is rotatable around the outside of the bottom section. This arrangement allows for rapid alignment of the flow nipple and flow line.

Each configuration of the present invention, or extendable conductor stand, allows the user to significantly reduce the time required to connect the conductor casing with the drilling platform.

In one instance, the time required to nipple up may be reduced, and the risk of working under the substructure of the rig can be minimized, by setting the conductor stand, with BOP protection, before assembly of the rig or before the drilling rig is walked over the prospective well bore. In this situation the cellar ring and the conductor flange may be set as described above, however, once the conductor is cut to the desired length in the cellar, the conductor pipe face can be cut or ground to a level configuration and a high pressure conductor flange may be welded into place. With the flange in place, the extendable conductor stand can be lifted using a crane, which typically will be on sight for assembly of the drill platform, set the extendable conductor onto the mating flange, and bolted together. The conductor stand can be lowered into a compact configuration to limit interference during assembly or while walking the rig over the conductor. Once the drill rig is in place, the upper section of the conductor can be attached to an air tugger, the lock collar loosened and the upper section raised to the desired height. Roughnecks under the subfloor can quickly rotate the upper section of the conductor to align the flow nipple and the lock collar can again be tightened.

If the drill platform is in place prior to setting the extendable conductor, the conductor stack can be completely or partially assembled prior to positioning over the ground conductor flange. The conductor can be shortened into a compact configuration to ease handling of the stand prior to installation. The conductor stand can be moved into position using an air tugger, with the bottom portion supported using heavy equipment. Once in position and the mating flanges are bolted together, the air tugger can extend the upper conductor section to the proper level, the flow nipple is aligned and the locking collar is tighten. It is expected that total installation time of the extendable conductor stand is about one hour.

With the extendable conductor stand of the present invention in place, the operation can now commence drilling for surface having a BOP for containment of surface anomalies. As discussed above, when anomalies are encountered at shallow depths, and due to a lack of mud weight, the possibility of a blowout is fairly high. The anomaly may be a gas pocket, or it is not uncommon to intercept pressurized ground water. If a gas pocket is intercepted, the gas coming up the conductor can be contained by the BOP inside of the extendable conductor and then diverted to a separator and flare stack away from the drilling rig. The BOP will remain closed until the gas anomaly can be controlled using drilling mud or concrete. If water is encountered, the BOP is closed and the water is diverted to a reserve pit until the breach is contained. With the use of the extendable conductor stand, water can be introduced to the surface hole by using one of the ports in the diverter spool. This will help preserve the integrity of the surface hole. Excess water is routed from the diverter spool to the reserve pit.

When surface has been drilled and the casing is in place, concrete can be introduced down the casing string to seal the casing in the surface hole, and the void between the casing and the conductor. The lowest valve or port in the diverter spool will then be opened to watch for concrete returns, which indicate that the bore is full.

Once the casing concrete is cured, the concrete quality and level can be inspected by loosening the lock collar set screws, lowering the top section of the conductor stand using the winch or air tugger, tightening the lock collar set screws, unbolting the lower diverter flange from the ground conductor flange, attaching the safety sling, and then lifting the complete conductor stand assembly up with the air tugger or the main draw works. This gives the operator a clear view inside the conductor and allows an easy check if the casing concrete has fallen. If the casing concrete has fallen, a concrete truck can simply back up to the ground conductor and add the concrete necessary to top off the hole. In another embodiment the operator may choose to re-install the bottom flange of the diverter spool and take advantage of closing the BOP to protect the rig from possible gases discharged from the surface anomaly. Concrete may be added through an upper port in the diverter spool while a low port is opened to watch for the concrete returns and determine if the casing void is now filled.

The extendable conductor stand can now be removed and may be stored under the drill rig subframe. The drill rig can be configured for finishing the well to a production level by cutting the surface casing and preparing a flange to attach the "A stack" or primary blowout protection.

One embodiment of the present invention or extendable conductor stand includes stabilizer ring attached to the upper portion of the conductor stand. The stabilizer ring is a high strength steel ring having a plurality of connection cut-outs. The stabilizer ring fits over the outside diameter of the upper section of the conductor pipe and is fixed in place by containment rings that are welded to the conductor pipe, one containment ring below the stabilizer ring and a second containment ring above the stabilizer ring. The containment rings forming a slot or groove where the stabilizer ring is free to rotate. The extendable conductor stand can be secured and stabilized by attaching a series of guy wires or turn buckles from the base of the drill rig subframe to the stabilizer rig cut outs. Since the stabilizer ring is able to rotate, the tension and alignment of the guy wires will equalize without applying any excess torsional force to the conductor stand. Additionally, alignment of the flow nipple and the upper section of the extendable conductor can be adjusted without releasing the guy wires.

These and other features and advantages of the disclosure will be set forth and will become more fully apparent in the detailed description that follows and in the appended claims. The features and advantages may be realized and obtained by the instruments and combinations particularly pointed out in the appended claims. Furthermore, the features and advantages of the disclosure may be learned by the practice of the methods or will be obvious from the description, as set forth hereinafter.

BRIEF DESCRIPTION OF DRAWING

The following description of the embodiments can be understood in light of the Figures, which illustrate specific aspects of the embodiments and are part of the specification. Together with the following description, the Figures demonstrate and explain the principles of the embodiments. In the Figures the physical dimensions of the embodiment may be exaggerated for clarity. The same reference numerals in different drawings represent the same element, and thus their descriptions may be omitted.

DETAIL DESCRIPTION OF THE DRAWINGS

Figure 1:
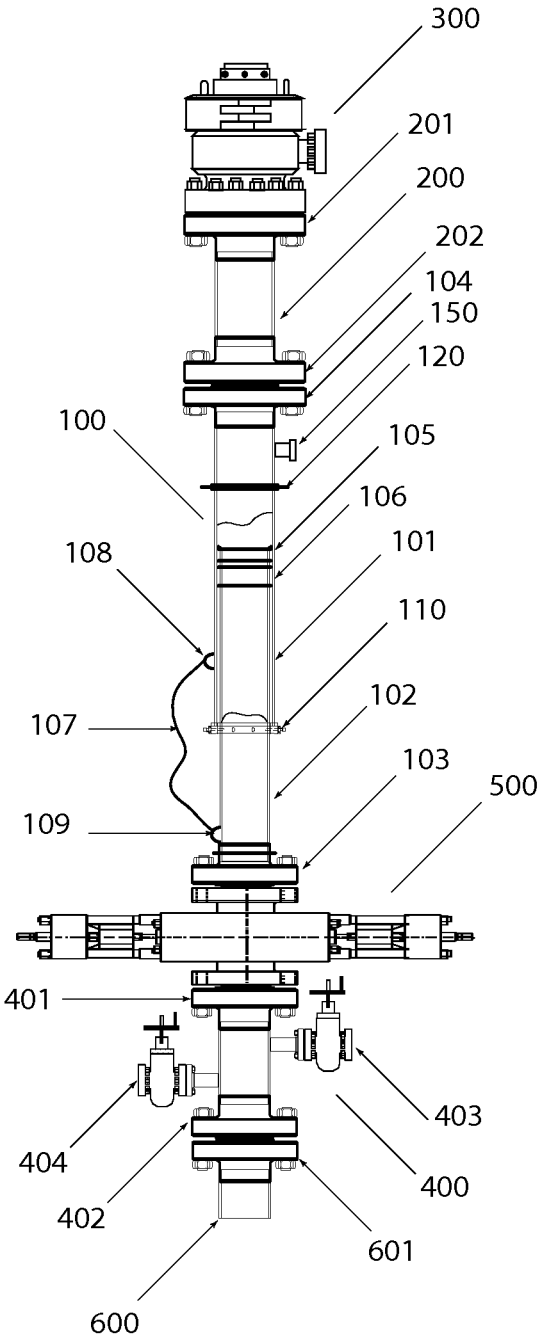
FIG. 1 is one embodiment of the present invention or extendable conductor stand.
Figure 2:
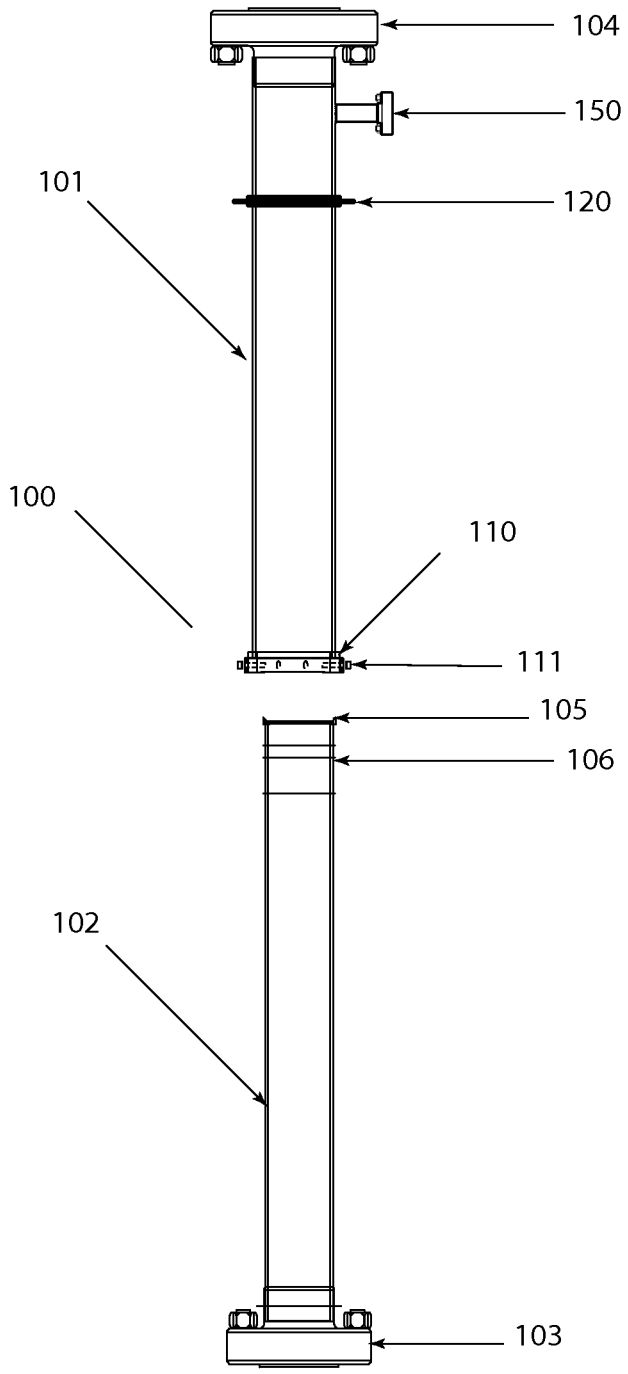
FIG. 2 is one embodiment of the extendable conductor stand.

FIG. 1 through 4B is one embodiment of the present invention or extendable conductor stand 100 configured showing the rotary head 300, extension spool piece 200, diverter spool 400 and optional blow protector or BOP 500. Extendable conductor 100 stand having, an upper section 101, having a first diameter and a bottom section 102, having a second diameter, smaller than the diameter of the upper section 101, and allowing lower section 102 to nest or telescope into upper section 101. The free end of each of sections 101 and 102 including a high pressure flange to allow easy connection between the ground conductor section 600 and other system components. The top lip of lower conductor section 102 includes a chamfered flange 105 to act as centering guide for the drill bit or casing sections extended through the extendable conductor 100. In one embodiment the chamfered flange 105 is a tapered section formed on the inside circumference of lower conductor section 102. In another embodiment the chamfered flange 105 is a preformed or machined section that is welded to the upper lip of lower conductor section 102. The assembly of the top section 101 and bottom section 102 is pressure sealed by seal assembly 106 formed on the outside diameter of lower conductor section 102 and engages the inside diameter of upper conductor section 101. Seal assembly 106, may be stacked fiber seal rings, o-rings or may be neoprene, silicone, viton, buna, rubber, or a similar material bushing block. Upper conductor section 101 and lower conductor sections 102 are configured to moveably interlock, allowing an operator to easily change the length and orientation of the conductor stand 100. When the conductor stand 100 is set to the desired length, the operator may tighten the locking bolts 111 (FIG. 2) on lock collar 110. In one embodiment an upper safety ring 108 is attached to the upper conductor section 101 and a lower safety ring 109 is attached to the lower conductor section 102. Lower conductor section 102 can be connected to upper conductor section 101 by connecting a safety sling 107 between the upper safety ring 108 and lower safety ring 109. Safety sling 107 is used to prevent accidently dropping the lower conductor section 102 during assembly or lifting. One embodiment of the extendable conductor stand 100 of the present invention includes a rotating stabilizer collar 120. One embodiment of the extendable conductor stand 100 including a flow line nipple 150 attached to upper conductor section 101.

It is understood that the extendable conductor stand 100 of the present invention may not fit, or may not be long enough, for each drill rig configuration. In order to accommodate drill rigs having subframes of different heights, extendable conductor stand 100 may be coupled to one or more extension spools 200 having an upper flange 201 and lower flange 202. The length of the extension spool 200 will be determined by the height of the drill rig subframe measured from the top flange of the ground conductor section, minus the height of additional components including the diverter spool 400, BOP 500 and the operating length of the extendable conductor 100.

Figure 3:
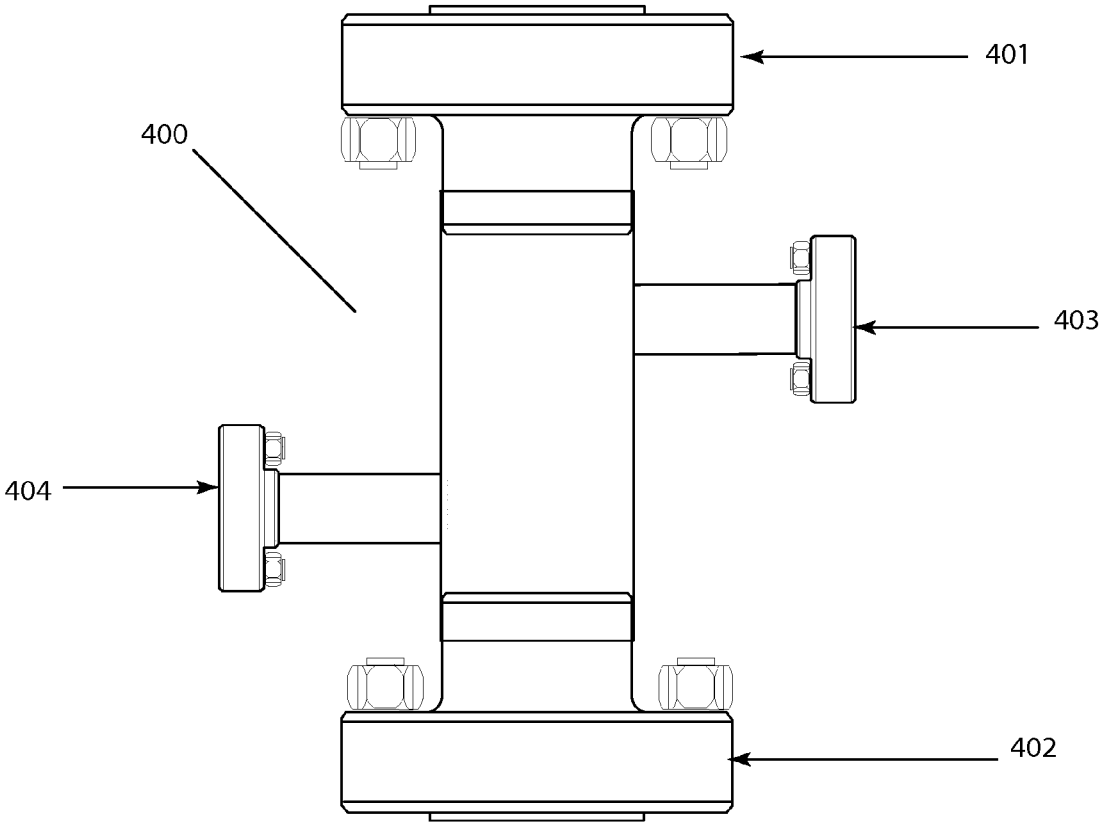
FIG. 3 is one embodiment of the diverter spool section.

The diverter spool 400, as shown in FIGS. 1 and 3, includes; upper flange 401, lower flange 402, upper diverter port 403 and lower diverter port 404. The diverter ports 403 and 404 may be used to bleed off drilling fluid or water and gas from anomalies in the formation. It is contemplated that in the event of a top job, concrete may be added through the upper diverter port 403, while lower port 404 is opened to check for concrete returns, indicating that the casing void is filed.

Figure 4A:
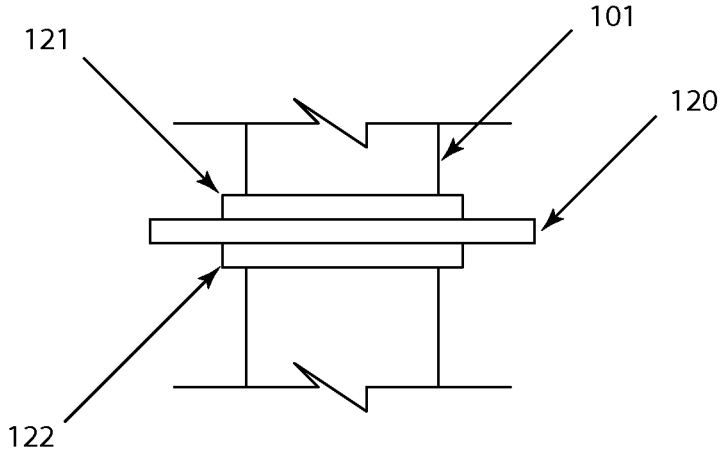
FIG. 4A is one embodiment of the stabilizer rig.
Figure 4B:
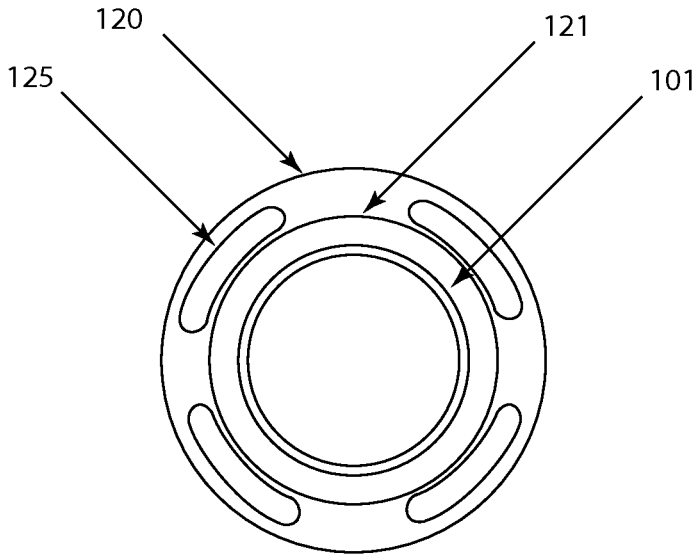
FIG. 4B is a top view of one embodiment of the stabilizer ring, FIG. 5 one embodiment of the present invention or extendable conductor stand installed under a drill platform.

FIG. 4A is side view of the rotating stabilization collar 120 loosely fitted on the outside diameter of the upper conductor section 101. Collar 120 is retained in place by upper containment ring 121 and lower containment ring 122, which are welded to the outside diameter of upper conductor section 101. Upper containment ring 121 and lower containment ring 122 forming a channel, or groove, where collar 120 is allowed to rotate about the vertical axis of upper conductor section 101. A plurality of attachment apertures 125 are formed in stabilization collar 120, as shown in FIG. 4B.

Figure 5:
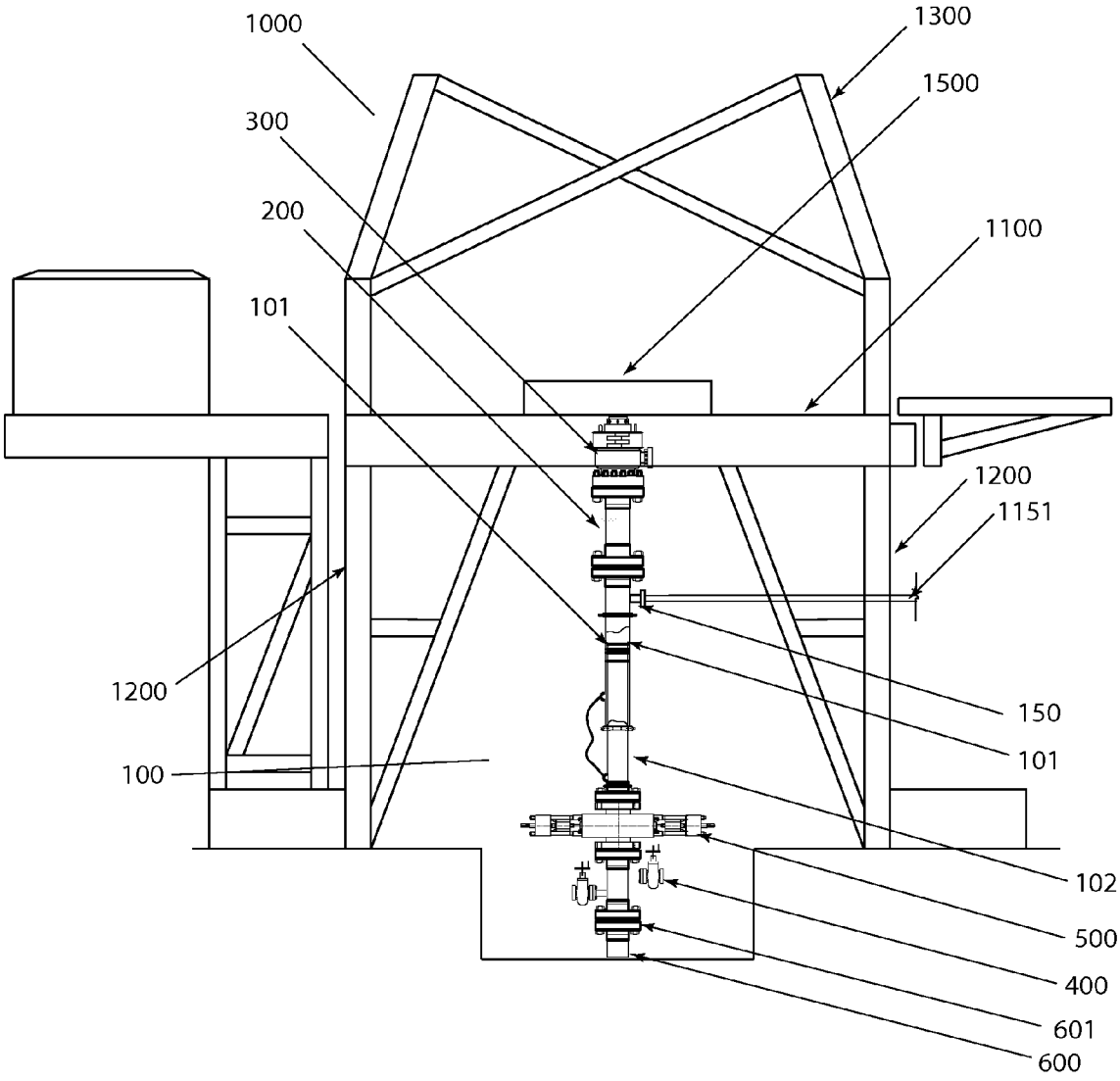

FIG. 5 is one embodiment of the present invention or extendable conductor stand 100 installed under a drill platform 1000. The extendable conductor stand assembly 100 includes an upper conductor section 101, a lower conductor section 102, extension spool piece 200, rotary head 300, blow out protector/preventer (BOP) 500, and diverter spool 400. The lower flange of the diverter spool 400 is bolted to the flange 601 of ground conductor 600. A flow line 1151 directed away from drill platform 1000 is attached to flow line nipple 150. Drill platform 1000 as shown describes the major components including the table or subfloor 1100, subframe 1200 and the derrick 1300.

Figure 6:
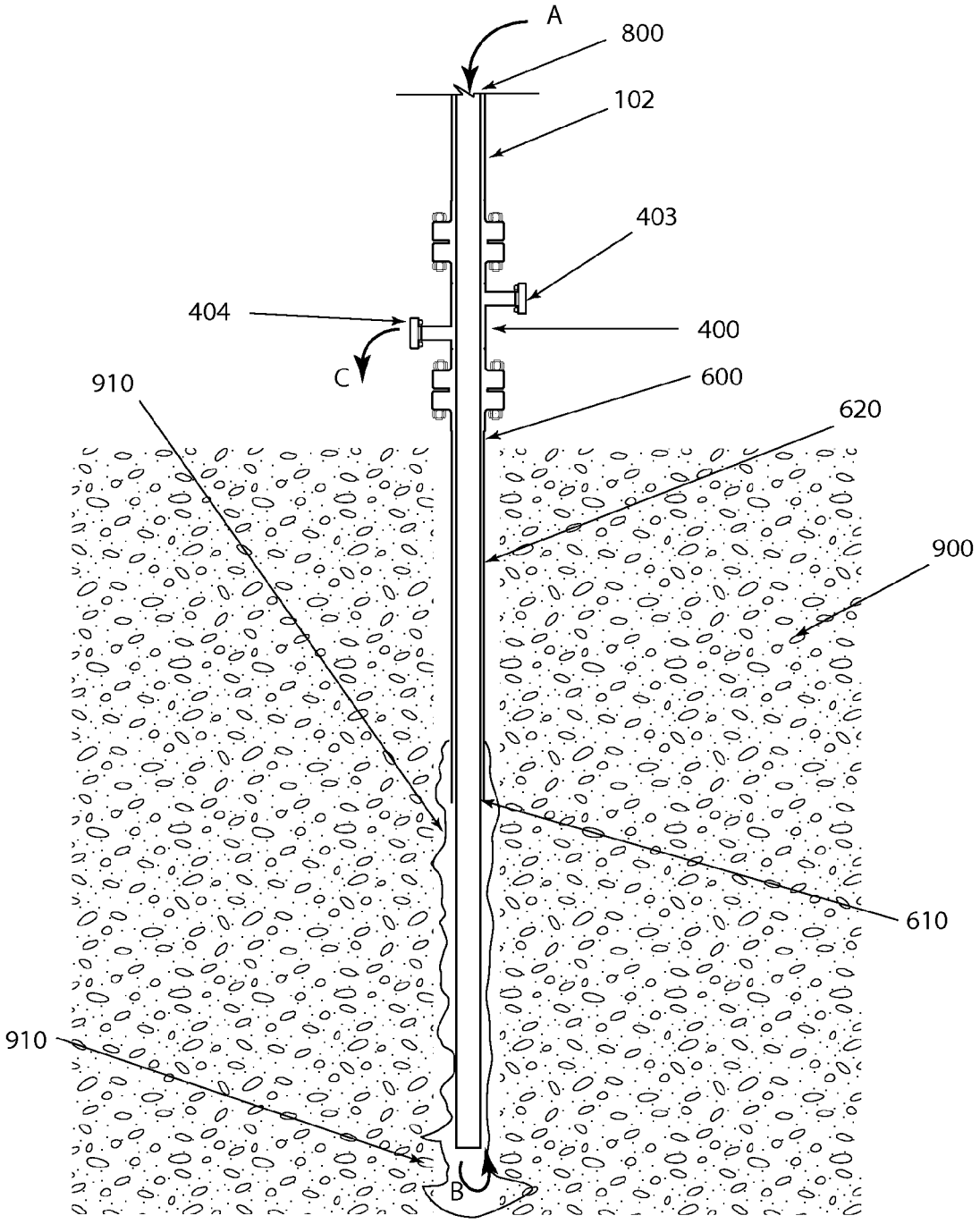
FIG. 6 is one embodiment of the diverter spool section and typical surface hole arrangement.

FIG. 6 is one embodiment of a surface hole having a ground conductor 600 with a diverter spool 400 and showing the lower section 102 of extendable conductor stand 100. A casing string 800 extends through the conductor section 102, the diverter spool 400, the ground conductor 600 and into the earth or ground 900. As shown, the inside diameter of the conductor sections 102, 400 and 600 is larger than the outside diameter of the casing string 800, leaving a void 620; additionally voids 910 are formed between the earth 900 and the casing 800. When cementing the surface hole, concrete is pumped down the casing string 800, (direction arrow A) and recirculates up (direction arrow B) the void 910 and enters the space or void 620 between the ground conductor 600 and casing string 800 at opening 610, when the concrete has recirculated back to the surface it will be discharged through lower diverter port 404 (direction arrow C). In the event that a "top job" is required, concrete is pumped into ground conductor 600 through upper diverter port 403.

It is to be understood that the above mentioned arrangements are only illustrative of the application of the principles of the present disclosure. Numerous modifications or alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. An extendable conductor stand comprising:

a bottom conductor section having a first outside diameter;

a top conductor section having a second inside diameter larger than the outside diameter of the bottom conductor section;

a portion of the bottom conductor section positioned inside of the top conductor section, wherein the bottom conductor section can be inserted into or extended out of the top conductor section, and;

a seal assembly between the inside diameter of the top conductor section and the outside diameter of the bottom conductor section; and a conductor lock mechanism fixedly attached to the top conductor section, the conductor lock mechanism includes a plurality of set screws that directly engage the outside diameter of the bottom conductor section and extend radially through the top conductor section.

2. The conductor stand of claim 1, wherein the seal assembly is one of stacked fiber seals, o-rings, viton, buna and neoprene.

3. The conductor stand of claim 1, including a blowout preventer attached to the bottom conductor section.

4. The conductor stand of claim 3, including a diverter spool attached to the bottom of the blowout preventer.

5. The conductor stand of claim 4 wherein the diverter spool includes a first diverter port at a first height on the diverter spool and second diverter port at second height on the diverter spool, the second diverter port lower than the first diverter port, the first diverter port having a diameter, the second diverter port having a diameter, and;

the first diverter port and the second diverter port offset such that the diameter of the first diverter port does not overlap with diameter of the second diverter port.

6. The conductor stand of claim 1, including an extension spool having a fixed length.

7. The conductor stand of claim 1, wherein the top conductor section includes a flow line nipple.

8. The conductor stand of claim 7, wherein the top conductor section is rotatable to facilitate alignment of the flow line nipple with a flow line.

9. The conductor stand of claim 1 including a first safety ring attached directly to the top conductor section and a second safety ring attached directly to the bottom conductor section.

10. The conductor stand of claim 9 including a safety sling attached between the first safety ring and the second safety ring.

11. A method of setting a conductor stand for drilling comprising;

providing a ground conductor section, preparing the ground conductor for a high pressure flange comprising, cutting or grinding to level, welding the high pressure flange to the ground conductor, setting the high pressure flange of the ground conductor to a first height, providing a drill platform having a subfloor of a second height, providing an extendable conductor stand having, a bottom conductor section having a first end, a second end, and a first outside diameter, a top conductor section having a first end, a second end, and a second inside diameter larger than the first outside diameter of the bottom conductor section, a seal section on the first end of the bottom conductor section configured to engage the inside diameter of the first end of the top conductor section, a high pressure flange on the second end of the top conductor section, a high pressure flange on the second end of the bottom conductor section, nesting the first end of the bottom conductor section inside of the first end of the top conductor section, providing a plurality of flange bolts, bolting the high pressure flange of the bottom conductor section to the high pressure flange of the ground conductor, and, extending the top conductor section until the high pressure flange of the top conductor section reaches the subfloor of the second height; providing the top conductor with a locking collar attached to the first end of the top conductor section, the locking collar having a plurality of set screws configured to directly engage the outside surface of the bottom conductor section and extend radially through the top conductor section, and, tightening the plurality of set screws to lock the top conductor section and the bottom conductor section at a fixed length.

12. The method of claim 11 including;

providing an extension spool having a fixed length, the extension spool having high pressure flanges, and, bolting one high pressure flange of the extension spool to the second end of the top conductor section.

13. The method of claim 11 including;

providing a diverter spool having a first high pressure flange, a second high pressure flange and at least one diverter port, providing a blowout preventer (BOP) configured to bolt to a high pressure flange, unbolting the high pressure flange of the bottom conductor section from the high pressure flange of the ground conductor, bolting the first high pressure flange of the diverter spool to the high pressure flange of the ground conductor, bolting the BOP to the second high pressure flange of the diverter spool, and, bolting the high pressure flange of the bottom conductor section to the BOP.

14. The method of claim 11 including;

providing a flow line nipple attached to the second end of the top conductor section, providing a flow line, and, rotating the top conductor section to align the flow line nipple with the flow line.

15. The method of claim 11 including;

providing a first safety ring attached directly to the top conductor section, providing a second safety ring attached directly to the bottom conductor section, providing a safety sling having a first end and a second end, attaching the first end of the safety sling to the first safety ring, and, attaching the second end of the safety sling to the second safety ring.

16. A method of cementing a well bore casing comprising:

providing a drilling platform having a subfloor with a drilling mechanism, providing a surface hole, providing an extendable conductor stand, providing a blowout preventer (BOP) configured to accept a high pressure flange, providing a diverter spool having an upper diverter valve and a lower diverter valve, providing a ground conductor, the drilling mechanism having a casing string extending down the surface hole, a void formed between the casing string and the surface hole, a void formed between the ground conductor and the casing string, the extendable conductor stand having, a bottom conductor section having a first end, a second end, and a first outside diameter, a top conductor section having a first end, a second end, and a second inside diameter larger than the first outside diameter of the bottom conductor section, a seal section on the first end of the bottom conductor section configured to engage the inside diameter of the first end of the top conductor section, a high pressure flange on the second end of the top conductor section, a high pressure flange on the second end of the bottom conductor section, a locking mechanism between the top conductor section and the bottom conductor section, nesting the first end of the bottom conductor section inside of the first end of the top conductor section, providing a plurality of flange bolts, bolting the diverter spool to the ground conductor flange, bolting the BOP to the top of the diverter spool, bolting the high pressure flange of the bottom conductor section to the top of the BOP, extending the top conductor section until the high pressure flange of the top conductor section reaches the subfloor, locking the lock mechanism, closing the BOP, opening the lower diverter valve, cementing the surface hole comprising;

pumping concrete down the casing string until the concrete fills the void between the surface hole and the casing string and the void between the ground conductor and the casing string and, the concrete returns through the lower diverter valve, allow time for concrete to cure, opening the BOP, unlocking the lock mechanism, lowering the top conductor section over the bottom conductor section, locking the lock mechanism, unbolting the diverter spool from the ground conductor, lifting the diverter spool, the BOP and the extendable conductor stand off of the ground conductor, inspect the concrete between the casing string and the ground conductor, if concrete has filed the void between the casing string and the ground conductor, cementing is complete, if the concrete has fallen back into the void between the casing string and the ground conductor, concrete must be added, wherein;

lower the diverter spool, the BOP and the extendable conductor stand on to the ground conductor, bolting the diverter spool to the ground conductor flange, closing the BOP, and, pumping concrete through the upper diverter valve and into the void between the casing string and the ground conductor until, the concrete returns through the lower diverter valve.

* * * * *